US005295424A

United States Patent [19]

Aulicky

[11] Patent Number: 5,295,424

[45] Date of Patent: Mar. 22, 1994

[54] PORTABLE MULTIPLE SHINGLE ROOF-CAP CUTTER AND METHOD OF USING SAME

[76] Inventor: Charles J. Aulicky, 7 Humphrey Rd., Annandale, N.J. 08801

[21] Appl. No.: 915,461

[22] Filed: Jul. 16, 1992

[51] Int. Cl.[5] ..... B26D 1/09

[52] U.S. Cl. ..... 83/56; 83/468.1; 83/636; 83/639.5; 83/693

[58] Field of Search ..... 83/687, 689, 693, 639.5, 83/468.1, 13, 56, 636

[56] References Cited

U.S. PATENT DOCUMENTS

| | | | |
|---|---|---|---|
| 1,531,287 | 3/1925 | Jensen | 83/693 X |
| 1,613,766 | 1/1927 | Parcher | 83/689 X |
| 1,665,600 | 4/1928 | Mortimer | 83/45 |
| 1,906,599 | 2/1933 | Hoffert | 83/589 |
| 1,981,695 | 11/1934 | Gundlach | 83/515 |
| 2,090,548 | 8/1937 | Nielsen | 83/605 |
| 2,325,311 | 7/1943 | Ducklo | 83/693 X |
| 2,423,423 | 7/1947 | Feitl | 83/693 |
| 2,779,325 | 1/1957 | Beckham | 125/23 |
| 3,779,119 | 12/1973 | Broides | 83/581 |
| 3,958,482 | 5/1976 | Claesson | 83/693 X |
| 4,510,834 | 4/1985 | Greene et al. | 83/453 |
| 4,516,450 | 5/1985 | Shuttleworth | 83/345 X |
| 4,869,143 | 9/1989 | Merrick et al. | 83/467.1 |
| 4,951,540 | 8/1990 | Cross et al. | 83/397 |
| 5,052,256 | 10/1991 | Morrissey | 83/468 |
| 5,123,829 | 6/1992 | Eason et al. | 83/639.1 |

*Primary Examiner*—Richard K. Seidel
*Assistant Examiner*—Kenneth E. Peterson
*Attorney, Agent, or Firm*—Michael W. Ferrell

[57] ABSTRACT

An apparatus for cutting each of a plurality of multi-tabbed shingles into smaller portions useful as roof-cap is disclosed and claimed. The apparatus includes upper and lower cutting plates mounted in reciprocating opposed spacial relationship. Preferably, the apparatus is pneumatically powered and it is possible to cut multiple shingles in a single operation.

8 Claims, 3 Drawing Sheets

PORTABLE MULTIPLE SHINGLE ROOF-CAP CUTTER AND METHOD OF USING SAME

FIELD OF INVENTION

The present invention relates generally to shingle cutters, and is more particularly directed to a portable, pneumatically operated shingle cutter capable of cutting multiple shingles in a single operation into a form suitable for roof-cap.

BACKGROUND OF INVENTION

Typically, roof-cap is manually cut from shingles by way of a utility knife. This job is time consuming, and depending upon the skill of the worker, may produce nonuniform pieces and substantial waste-product. Several machines have been proposed as described hereinafter; however, due to small gains in productivity, such machines have not been widely accepted or utilized.

U.S. Pat. No. 5,052,256 to Morrissey et al. discloses a shingle cutting apparatus including a base and a lever arm with a pair of diverging cutting blades mounted thereon. A pair of grooves are provided on the base corresponding to the cutting blades to facilitate cutting. The blades are angled so that the cutting apparatus cuts shingles into a six sided shape suitable for roof-cap. The apparatus of the '256 patent is designed to cut one shingle per operation and is hand-activated.

Another hand-activated shingle cutter is disclosed in U.S. Pat. No. 4,951,540 to Cross et al. The shingle cutter described in the '540 patent includes a pair of fixed blades on the base as well as a pair of movable blades mounted on a lever arm. In operation, a shingle is manually positioned along an edge of the base and cut to a combined trapezoidal/rectangular shape suitable for use as roof-cap.

Other vintage shingle-cutting devices and methods are disclosed in U.S. Pat. Nos. 2,779,325 to Beckham; 1,981,695 to Gundlach: 1,906,599 to Hoffert; and U.S. Pat. No. 1,665,600 to Mortimer. Like the devices of the '540 and '256 patents described above, the foregoing patents are generally directed to manually cutting one shingle per operation and are exceedingly labor-intensive as are cutting or punch devices such as those generally known, for example:

- the "Card File Punch" of Merrick et al. disclosed in U.S. Pat. No. 4,869,143;
- the "Siding Cutter" of Green et al. shown in U.S. Pat. No. 4,510,834;
- the "Mat Cutting Machine" of Broides, U.S. Pat. No. 3,779,119; and
- the "Trimming Device" of Nielsen described in U.S. Pat. No. 2,090,548.

A portable shingle cutter capable of cutting multiple shingles in a single operation while maintaining uniformity between pieces such as that of the present invention significantly increases production capability as well as maintains the quality of the end-product.

SUMMARY OF INVENTION

In accordance with the present invention, there is provided an apparatus for cutting a stack of multi-tabbed shingles into portions useful as roof-cap in a single cutting operation. The same is accomplished by way of a movable cutting plate with a plurality of cutting edges, a base plate provided with a plurality of cutting edges and means for positioning a stack of shingles therebetween. During a cutting operation, the shingles are in contact with the positioning elements of the apparatus so that there is no slippage and the cutting operation results in uniform product. Preferably, the apparatus is pneumatically powered and the stack of shingles is positioned by utilizing posts with fit securely into the tab-slot of the shingles.

BRIEF DESCRIPTION OF DRAWINGS

The invention is described in detail below with reference to the various figures wherein like numerals designate similar parts and in which.

DETAILED DESCRIPTION

The following illustrations and examples are provided for purposes of exposition and not limitation. One of skill in the art will readily appreciate that modification, improvement and embodiments other than shown here are possible. Likewise, terminology is selected for convenience and should be interpreted in the context and spirit hereof. For example the present invention is specifically described in terms of a movable plate and a base plate. Such language refers to relative motion only and that such language includes a pair of mutually hinged, opposing plates.

Figure 1:
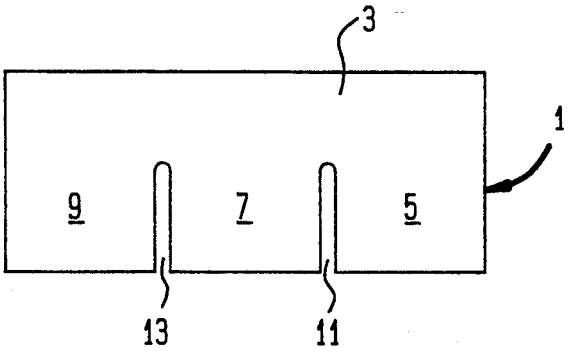
FIG. 1 is a plan view of a typical 3-tabbed shingle.
Figure 2:
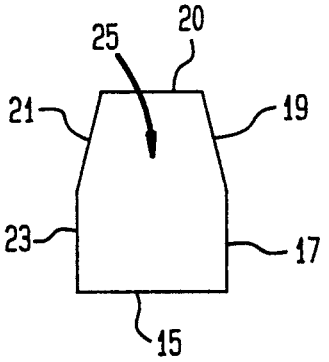
FIG. 2 is a plan view of a hexagonal cut-out suitable for use as roof-cap produced from the 3-tabbed shingle of FIG. 1.

Turning to the figures, there is shown in FIG. 1 a typical 3-tabbed roofing shingle, commonly used in residential applications. Shingle 1 has an upper portion 3 as well as 3 tabs, 5, 7, and 9 respectively defining between them a pair of slots 11, 13. It is an object of the present invention to cut shingle into three smaller portions, such as that shown in FIG. 2. FIG. 2 is a plan view of a portion of shingle 1 having 6 sides 15, 17, 19, 20, 21 and 23 such that it is hexagonal in geometry, as shown. This shape, among others, is suitable for roof-cap; the shape illustrated being generally most preferred.

Figure 3:
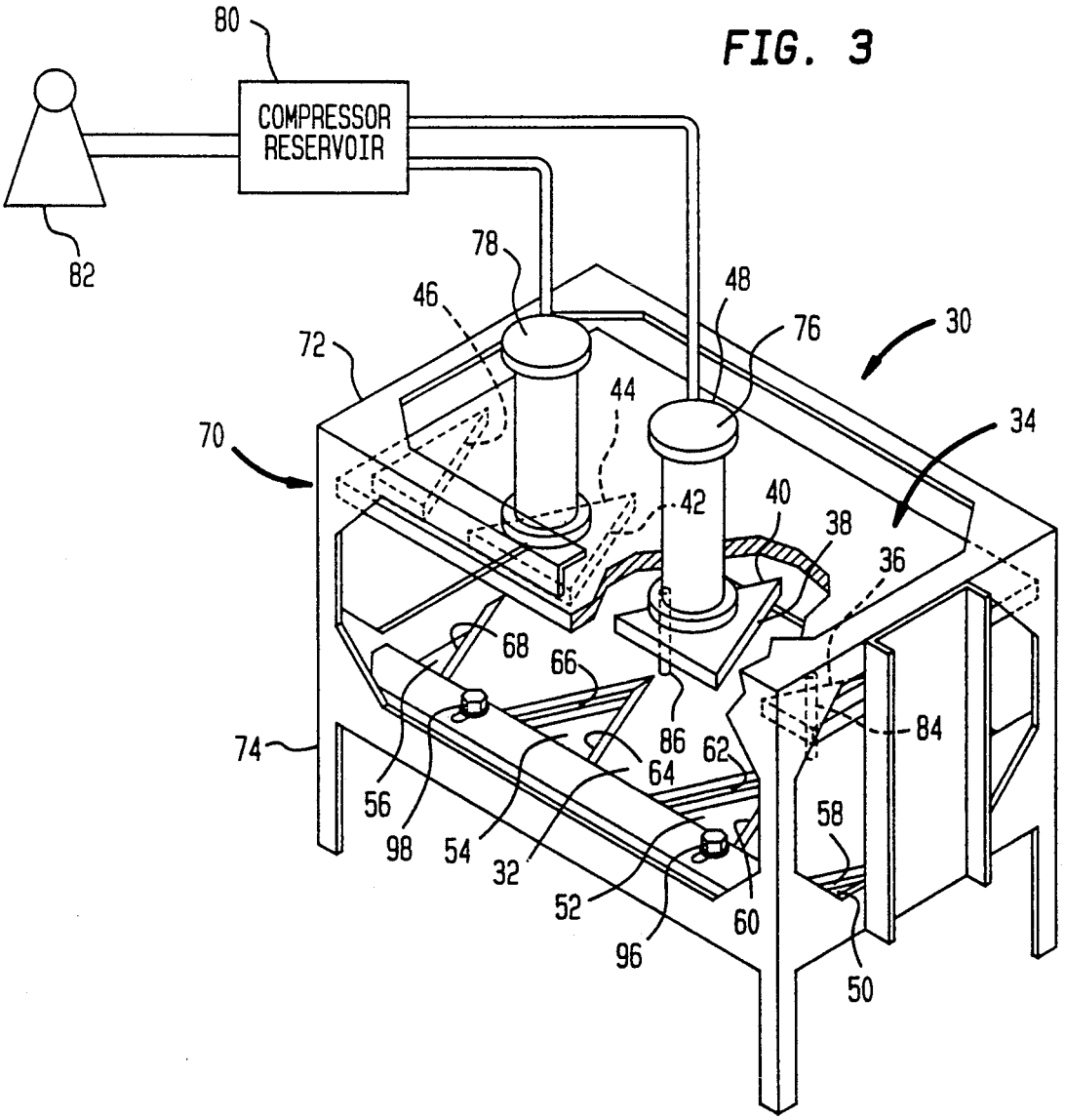
FIG. 3 is a perspective view of an apparatus constructed in accordance with the present invention.

The cutting operation, that is getting from shingle 1 to portion 25 is accomplished by way of inventive apparatus 30 of FIG. 3. In accordance with the present invention, apparatus 30 has a base plate 32 and a movable upper cutting plate 34. Plate 34 has a plurality of cutting blades 36, 38, 40, 42, 44 and 46 mounted thereon, all forming an acute angle with edge 48 of plate 34 so that the required cuts can be made. Base plate 32 has a series of openings 50, 52, 54 and 56 which have cutting edges 58, 60, 62, 64, 66 and 68 corresponding to blades 36, 38, 40, 42, 44 and 46 of plate 34. In operation, the various cutting edges cooperate to cut a shingle, such as shingle 1 into 3 portions such as portion 25.

Plates 32, 34 are supported on a frame 70 including a bridge portion 72 and a base portion 74. A pair of actuating cylinders 76, 78 are mounted atop bridge portion 72 upon which plate 32 is reciprocally mounted. Cylinders 76, 78 are preferably 4 stroke, 1.5" bore, however any suitable working cylinder may be used so long as it generates sufficient force. Pneumatic cylinders may be preferred, however a hybrid pneumatic/hydraulic system may in some circumstances be superior. Both types of systems are referred to herein as "pneumatic" for purposes of convenience. Cylinders 76, 78 are connected to a high pressure reservoir 80 which in turn is connected to a compressor 82. Compressor 82 is of the portable type having a maximum output of about 150 psig, and apparatus 30 is preferably constructed so that it will operate satisfactorily at such pressures.

Base plate 32 is further provided with a pair of positioning posts, 84, 86 the salient features of which are discussed further hereinafter. Suffice it to say for present purposes, that during operation of apparatus 30, posts 84, 86 receive the slots, such as slots 11 and 13 of shingle 1, of a plurality of shingles to be cut into smaller portions for roof-cap.

Figure 4:
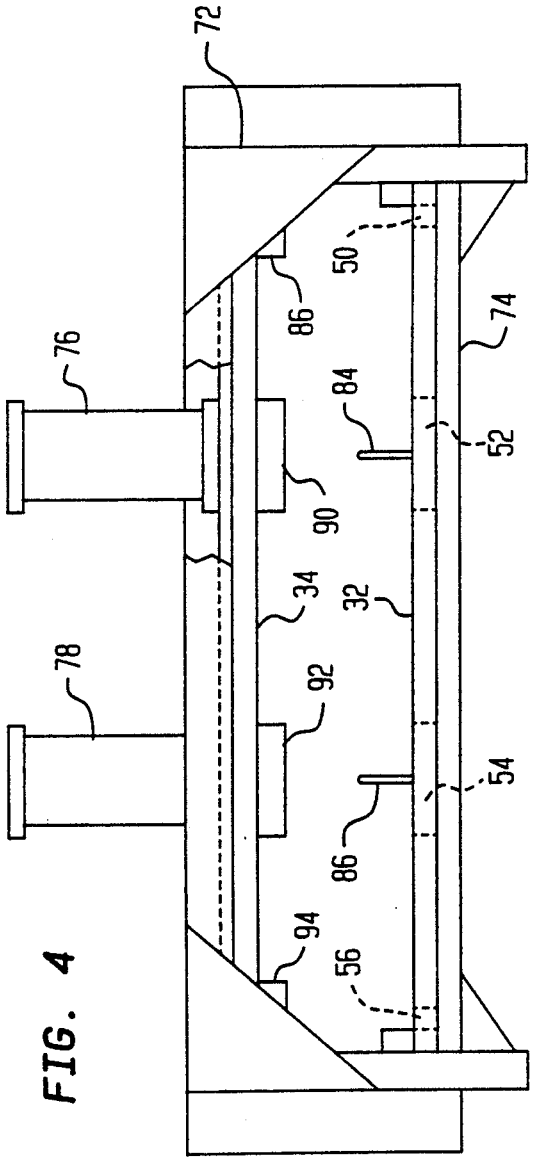
FIG. 4 is a view in elevation of the apparatus of FIG. 3.

Design details and operation of the inventive apparatus 30 are illustrated and explained with reference to FIGS. 4 through 8. FIG. 4 is a side view in elevation of apparatus 30 of FIG. 3, wherein like parts bear like numerals for identification. Upper blades 36, 38, 40, 42, 44 and 46 are mounted on four angular punches 88, 90, 92 and 94 secured to plate 34. Plate 34 is reciprocally mounted on a bridge 72 so that punches 88, 90, 92 and 94 are reciprocally opposed to openings 50, 52, 54 and 56 in plate 32, as shown in FIG. 4. The upper blades 36–46 may be integrally formed on the punches 88–94 or may be detachably secured thereto. The openings 50–56 are preferably in the form of relief in plate 32, as illustrated in 5, which is a plan view of apparatus 30 with bridge 72 removed, that is, along with upper plate 34 and the actuating cylinders.

Plate 32 is desirably mounted on a lower frame 74 which is operative as a side guide and is preferably provided with a plurality of slots, 96, 98 so that its axial position relative to plate 34 is adjustable.

Figure 6:
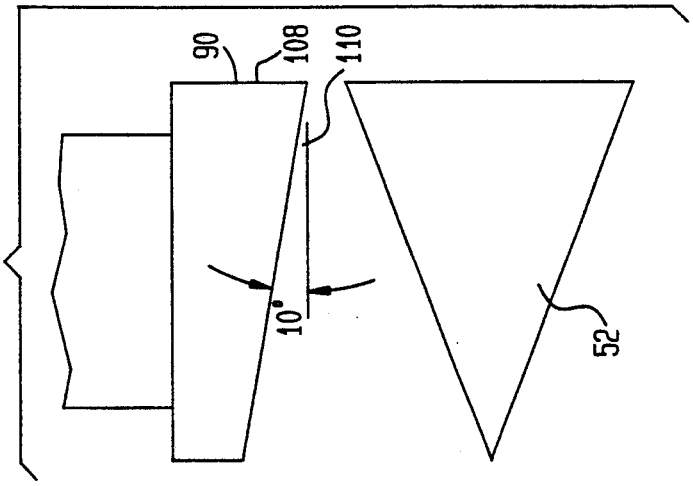
FIG. 6 is a detail of a punch which is mounted on a punch plate as shown in FIG. 4.
Figure 5:
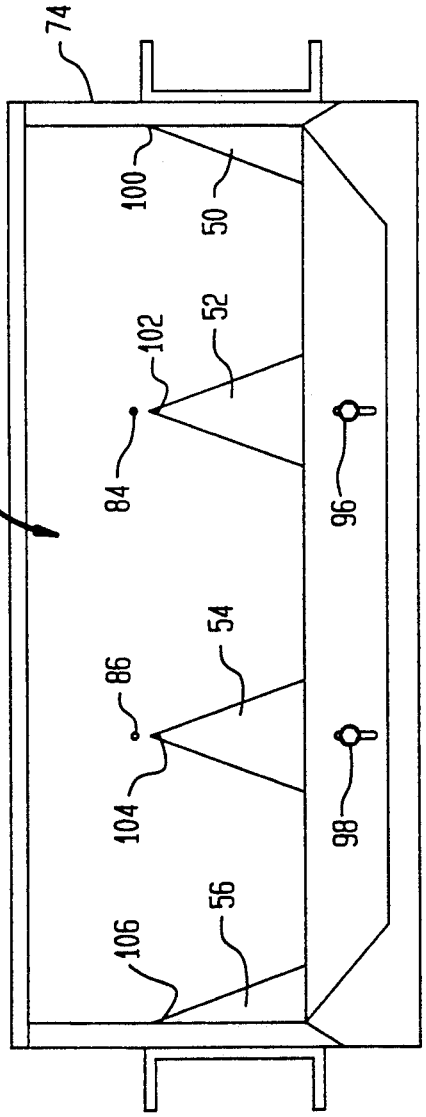
FIG. 5 is a plan view of a base plate useful in connection with the apparatus of FIGS. 3 and 4.

Most preferably, the punches 88–94 and corresponding upper cutting blades 36–46 are provided with a pitch of inclination relative to the plate surface as shown in FIG. 6. That is, the upper cutting blades project more outwardly from plate 34 at one of their terminii with a pitch, for example, towards the apexes 100, 102, 104, 106 of openings 52–56 where the cut is made last. Thus a punch 90 and corresponding blades 38, 40 are thickest at the base of triangular portion 50, at 108 shown in FIG. 6. The pitch is mostly preferably inwardly directed so that a shingle is urged against a post, such as post 84 when cut. The pitch may be at any angle 110 from about 5 to about 20 degrees; about 10 degrees being most preferred. If an inward pitch is unnecessary, an outward pitch will likewise be preferable to a cutting blade parallel to the surface of plate 34.

Figure 7:
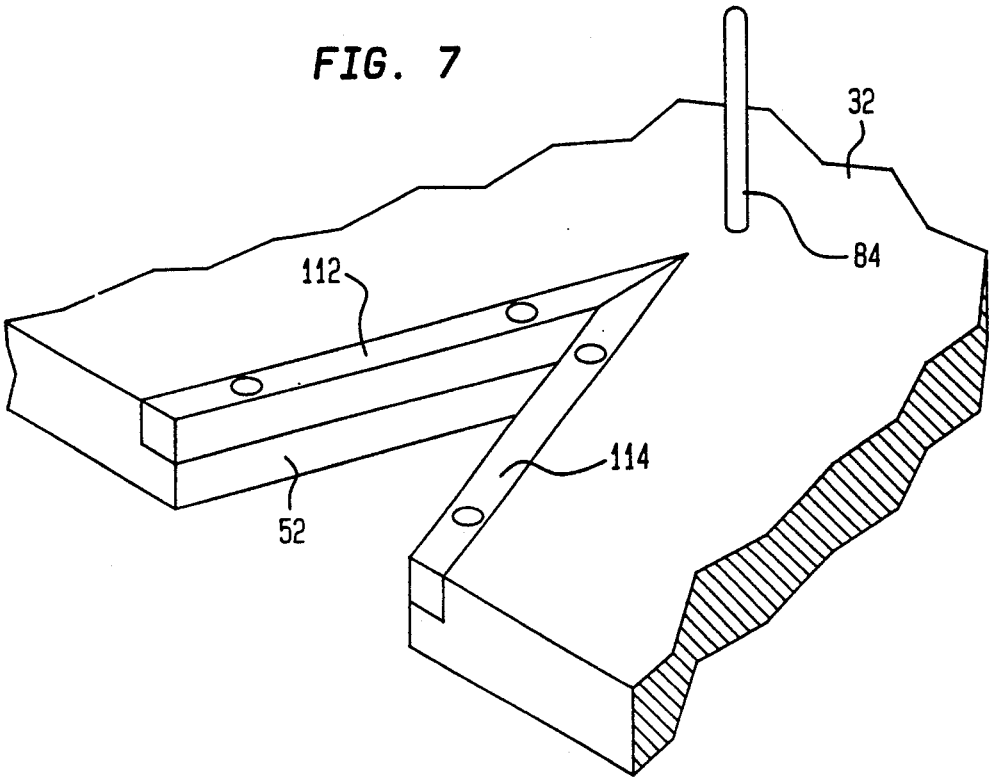
FIG. 7 is a detail of a base plate of the type shown in FIGS. 3, 4, and 5.
Figure 8:
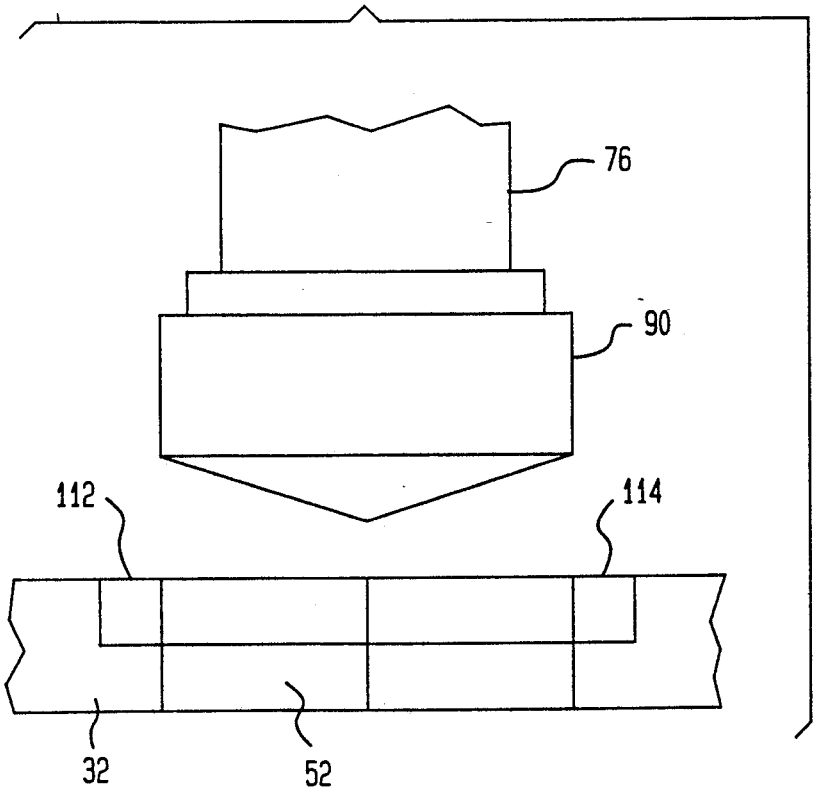
FIG. 8 is a schematic illustration of the cooperation of a punch and base plate in accordance with the present invention.

Turning to FIG. 7, there is shown in schematic form a portion of lower plate 32. There is additionally provided however, removable inserts 112, 114 which are used as the lower cutting blades, such as blades 58–68. Inserts 112, 114 may be made of any suitable material, preferably of hardened steel. There is shown in FIG. 8 a punch 90 (with an outward pitch) as it would cooperate with base plate 32 to cut a plurality of shingles.

Due to the unique construction of the apparatus of the present invention, it is possible to stack multiple shingles on the lower plate 32 about posts 84, 86 so that at least 6 and up to one dozen shingles can be cut into roof-cap in a single operation. Moreover, since the positioning depends only upon the slots, such as slots 11, 13 the inventive apparatus can be readily adapted to cut shingles of even non-uniform size.

The invention has been described hereinabove in detail and is thus illustrated throughout the various figures. Further illustration is believed unnecessary. Modifications within the spirit and scope of the present invention will be apparent to those of skill in the art. Accordingly, the present invention is limited and defined only by the appended claims.

What is claimed is:

1. A method of cutting a plurality of multi-tabbed shingles into portions suitable for use as roof-cap comprising in combination;

(a) positioning a plurality of multi-tabbed shingles provided with slots on a stationary base-plate such that said slots of said shingles are disposed about two positioning posts affixed to said stationary base plate, which posts limit the lateral and longitudinal motion of said plurality of multi-tabbed shingles, said base plate being further provided with a first plurality of cutting edges, and (b) cutting said multi-tabbed shingles by way of a movable cutting plate having a second plurality of cutting edges positioned, configured and dimensioned to cooperate with said first plurality of cutting edges to cut said shingles into portions suitable for use as roof-cap.

2. The method according to claim 1, wherein said step of cutting said shingles is achieved by way of pneumatically powering said movable cutting plate.

3. The method according to claim 2, wherein said step of pneumatically powering said movable cutting plate comprises powering said movable cutting plate with a four-stroke pneumatic cylinder.

4. The method according to claim 1, wherein said first plurality of cutting edges are removable.

5. The method according to claim 4, wherein said second plurality of cutting edges are removable.

6. The method according to claim 1, wherein said cutting edges are positioned, configured and dimensioned so as to cut said plurality of multi-tabbed shingles into hexagonal portions.

7. The method according to claim 1, wherein said second plurality of cutting edges of said movable cutting plate are provided with a pitch relative to the surface of said cutting plate.

8. The method according to claim 7, wherein said second plurality of cutting edges are configured so as to be operative to urge said plurality of multi-tabbed shingles into contact with said two positioning posts affixed to said base plate during a cutting operation.

* * * * *